US008212475B2

(12) United States Patent
Yamashita et al.

(10) Patent No.: US 8,212,475 B2
(45) Date of Patent: Jul. 3, 2012

(54) PHOTOCATHODE, ELECTRON TUBE, AND PHOTOMULTIPLIER TUBE

(75) Inventors: Shinichi Yamashita, Hamamatsu (JP); Hiroyuki Watanabe, Hamamatsu (JP); Hiroshi Komiyama, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 12/752,678

(22) Filed: Apr. 1, 2010

(65) Prior Publication Data

US 2010/0253218 A1 Oct. 7, 2010

(30) Foreign Application Priority Data

Apr. 2, 2009 (JP) ..... P2009-090179

(51) Int. Cl.
*H01J 43/18* (2006.01)

(52) U.S. Cl. ..... 313/532; 313/533; 313/103 R

(58) Field of Classification Search ..... 313/532, 313/533, 541, 542–544, 103 R, 107
See application file for complete search history.

(56) References Cited

U.S. PATENT DOCUMENTS

| | | | | |
|---|---|---|---|---|
| 3,254,253 | A | 5/1966 | Davis et al. | |
| 3,617,743 | A * | 11/1971 | Rabatin et al. | 250/214 VT |
| 4,490,605 | A | 12/1984 | Dolizy et al. | |
| 5,074,899 | A * | 12/1991 | Howorth | 65/30.13 |
| 5,336,966 | A | 8/1994 | Nakatsugawa et al. | |
| 2010/0096985 | A1 | 4/2010 | Watase et al. | |

FOREIGN PATENT DOCUMENTS

| | | |
|---|---|---|
| EP | 1939917 | 7/2008 |
| JP | S49-084362 | 8/1974 |
| JP | 05-052444 | 3/1993 |
| JP | 052444 | 8/1993 |
| JP | 083561 | 3/1996 |
| JP | 2008-166262 | 7/2008 |

* cited by examiner

*Primary Examiner* — Vip Patel
(74) *Attorney, Agent, or Firm* — Drinker Biddle & Reath LLP

(57) ABSTRACT

In the photocathode, an underlayer made of a crystalline material containing $La_2O_3$ is provided between a supporting substrate and a photoelectron emission layer, and is in contact with the photoelectron emission layer. Therefore, for example, at the time of heat treatment in a manufacturing process of the photocathode, dispersion to the supporting substrate side of an alkali metal contained in the photoelectron emission layer is suppressed. Further, it is assumed that this underlayer functions so as to reverse the direction of, out of photoelectrons $e^-$ generated within the photoelectron emission layer, photoelectrons traveling toward the supporting substrate side to the side opposite thereto.

15 Claims, 9 Drawing Sheets

Fig.4

(a)

| STRUCTURE NO. | UNDERLAYER |
|---|---|
| 1 | $La_2O_3$ |
| 2 | $La_2O_3$-BeO,$La_2O_3$/BeO |
| 3 | $La_2O_3$-MgO,$La_2O_3$/MgO |
| 4 | $La_2O_3$-MnO,$La_2O_3$/MnO |
| 5 | OXIDE OF La-ALLOY |
| 6 | $La_2O_3$-BASED FOUNDATION LAYER/ AR-COATING ($HfO_2$,$Y_2O_3$) |

(b)

| STRUCTURE NO. | |
|---|---|
| 1 | K-CsSb($K_2CsSb$) |
| 2 | Na-KSb($Na_2KSb$) |
| 3 | Cs-Na-KSb(Ca($Na_2K$)Sb) |
| 4 | Cs-Te($Cs_2Te$) |

*Fig.7*

| STRUCTURE NO. | UNDERLAYER |
|---|---|
| 11 | $La_2O_3$/LANTHANUM GLASS |
| 12 | $La_2O_3$-BeO |
| 13 | $La_2O_3$-$Y_2O_3$ |
| 14 | $La_2O_3$-$HfO_2$ |

PHOTOCATHODE, ELECTRON TUBE, AND PHOTOMULTIPLIER TUBE

BACKGROUND OF THE INVENTION

1. Field of the Invention

One embodiment of the present invention relates to a photocathode that emits photoelectrons in response to incidence of light, and an electron tube and a photomultiplier included with such a photocathode.

2. Related Background Art

A photocathode is, as described in, for example, U.S. Pat. No. 3,254,253 and Japanese Published Examined Patent Application No. H05-52444, a device that emits electrons (photoelectrons) generated in response to an incident light. Such a photocathode is favorably applied to an electron tube such as a photomultiplier tube. In addition, the photocathode can be of two types: a transmission type and a reflection type, according to the difference in supporting substrate materials to be applied thereto.

In a transmissive photocathode, a photoelectron emission layer is formed on a supporting substrate made of a material that transmits an incident light, and a part of the transparent vessel of a photomultiplier tube or the like functions as the supporting substrate. In this case, when an incident light that has transmitted through the supporting substrate reaches the photoelectron emission layer, photoelectrons are generated within the photoelectron emission layer in response to the reached incident light. As a result of an electric field for extracting photoelectrons being formed on the side opposite to the supporting substrate in relation to the photoelectron emission layer, the photoelectrons generated in the photoelectron emission layer are emitted toward a direction coincident with a traveling direction of the incident light.

On the other hand, in a reflective photocathode, a photoelectron emission layer is formed on a supporting substrate made of a material that blocks an incident light, and the supporting substrate is arranged inside of a transparent vessel of a photomultiplier tube. In this case, the supporting substrate functions as a reinforcing member that supports the photoelectron emission layer, and an incident light directly reaches the photoelectron emission layer while avoiding the supporting substrate. Within the photoelectron emission layer, photoelectrons are generated in response to the reached incident light. The photoelectrons generated in the photoelectron emission layer are, as a result of an electric field for extracting photoelectrons being formed on the side opposite to the supporting substrate in relation to the photoelectron emission layer, emitted to the side from which the incident light has traveled in relation to the supporting substrate.

SUMMARY OF THE INVENTION

As a result of studies on the conventional techniques described above, the present inventors have discovered the following problems. That is, a higher spectral sensitivity is preferable as a spectral sensitivity required for the photocathode serving as a photoelectric conversion device. In order to increase the spectral sensitivity, it is necessary to enhance an effective quantum efficiency of said photocathode indicating a ratio of the number of emitted photoelectrons to the number of incident photons. For example, in U.S. Pat. No. 3,254,253 and Japanese Published Examined Patent Application No. H05-52444, photocathodes provided with an anti-reflection coating or an intermediate layer between the supporting substrate and the photoelectron emission layer have been studied.

However, in recent years, a further improvement in quantum efficiency has been demanded.

One embodiment of the present invention has been made in view of such circumstances, and it is an object of the present invention to provide a photocathode that can improve the effective quantum efficiency, and an electron tube and a photomultiplier tube included with such a photocathode.

In order to achieve the above object, a photocathode according to one embodiment of the present invention, which emits photoelectrons in response to incidence of light, includes: a supporting substrate; an underlayer provided on the supporting substrate; and a photoelectron emission layer provided on the underlayer, and made of a material containing an alkali metal, and the underlayer is made of a crystalline material containing lanthanum oxide, and in contact with the photoelectron emission layer.

In this photocathode, the underlayer made of a crystalline material containing lanthanum oxide ($La_2O_3$) is provided between the supporting substrate and the photoelectron emission layer, and is in contact with the photoelectron emission layer. Therefore, for example, at the time of heat treatment in a manufacturing process of the photocathode, dispersion to the supporting substrate side of an alkali metal contained in the photoelectron emission layer can be suppressed. Consequently, a decline in the quantum efficiency of the photoelectron emission layer can be effectively suppressed. Further, it is assumed that this underlayer functions so as to reverse the direction of, out of photoelectrons generated within the photoelectron emission layer, photoelectrons traveling toward the supporting substrate side to the side opposite thereto. For this reason, it is considered that the quantum efficiency of the photocathode as a whole is dramatically improved. As above, according to this photocathode, the effective quantum efficiency can be improved. Here, the effective quantum efficiency means a quantum efficiency in terms of not only the photoelectron emission layer, but also a quantum efficiency of the photocathode as a whole including the supporting substrate etc. That is, the effective quantum efficiency also reflects factors such as the transmittance of the supporting substrate.

Moreover, when a ratio of a thickness of the photoelectron emission layer to a thickness of the underlayer is 0.06 to 400, the effective quantum efficiency can be further improved.

Moreover, even when the photoelectron emission layer is made of a material containing a compound of the alkali metal and antimony (Sb), and further, even when the photoelectron emission layer is made of a material containing at least one of cesium (Cs), potassium (K), and sodium (Na) as the alkali metal, a high quantum efficiency can be obtained.

Moreover, even when the underlayer is made of any one of the materials of a material containing mixed crystals of the lanthanum oxide and beryllium oxide (BeO), a material containing mixed crystals of the lanthanum oxide and magnesium oxide (MgO), and a material containing mixed crystals of the lanthanum oxide and manganese oxide (MnO), a high quantum efficiency can be obtained. The underlayer may be made of any one of the materials of a material containing mixed crystals of the lanthanum oxide and a rare earth element, a material containing mixed crystals of the lanthanum oxide and an alkaline earth element, and a material containing mixed crystals of the lanthanum oxide and a titanium family element.

Moreover, when an anti-reflection coating made of a material containing at least one of hafnium oxide ($HfO_2$) and yttrium oxide ($Y_2O_3$) is provided between the supporting substrate and the underlayer, light can be made incident into the photoelectron emission layer more efficiently.

Moreover, the photocathode may be a so-called transmissive photocathode where the supporting substrate is made of a material that transmits light, and the photoelectron emission layer makes the light incident from the supporting substrate side, and emits the photoelectrons to a side opposite to the supporting substrate, or may be a so-called reflective photocathode where the supporting substrate is made of a material that blocks light, and the photoelectron emission layer makes the light incident from a side opposite to the supporting substrate, and emits the photoelectrons to the side opposite to the supporting substrate.

Moreover, an electron tube according to one embodiment of the present invention includes: the photocathode described above; an anode that collects photoelectrons emitted from the photocathode; and a vessel that stores the photocathode and the anode.

Further, a photomultiplier tube according to one embodiment of the present invention includes: the photocathode described above; an electron multiplying section for cascade-multiplying photoelectrons emitted from the photocathode; an anode that collects secondary electrons emitted from the electron multiplying section; and a vessel that stores the photocathode, the electron multiplying section, and the anode.

Because of being included with the photocathode described above, the electron tube and photomultiplier tube can improve the effective quantum efficiency.

BRIEF DESCRIPTION OF THE DRAWINGS

FIG. 4 are tables for explaining the types of underlayer structures and the types of photoelectron emission layer structures applied to samples prepared as examples of photocathodes according to the present invention.

FIG. 7 is a table for explaining the types of underlayer structures applied to samples prepared as other examples of photocathodes according to the present invention.

DESCRIPTION OF THE PREFERRED EMBODIMENTS

Figure 1:
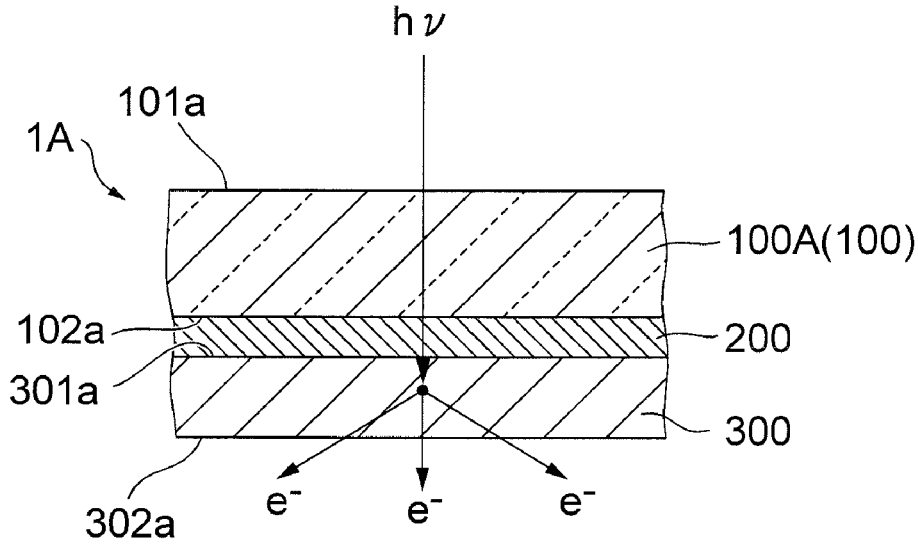
FIG. 1 are sectional views of embodiments of photocathodes according to the present invention.
Figure 1:
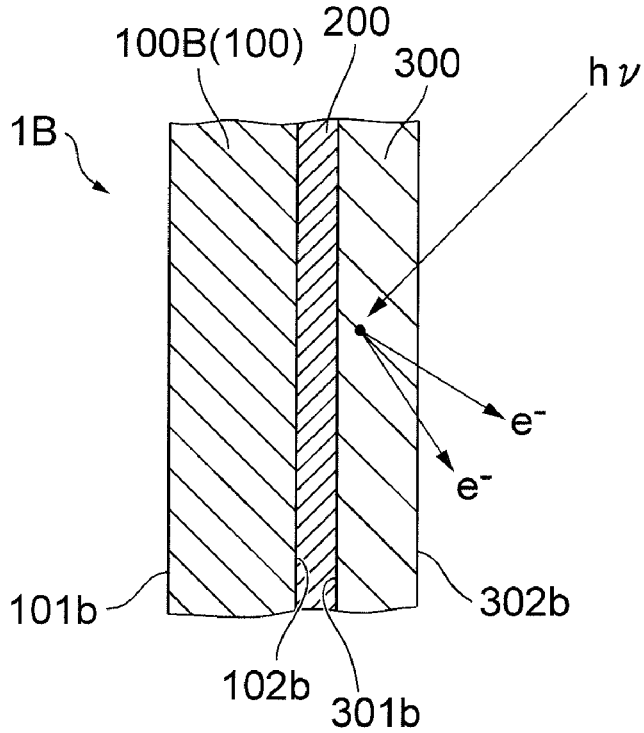

Hereinafter, preferred embodiments of the present invention will be described with reference to the drawings. Also, the same or corresponding parts are denoted with the same reference numerals in the respective drawings, and overlapping description will be omitted.

FIG. 1(*a*) is a sectional view of a transmissive photocathode, which is an embodiment of a photocathode according to the present invention. As shown in FIG. 1(*a*), the transmissive photocathode 1A includes a supporting substrate 100A that transmits an incident light hν with a predetermined wavelength, an underlayer 200 provided on the supporting substrate 100A, and a photoelectron emission layer 300 provided on the underlayer 200. The supporting substrate 100A has a first main surface 101*a* that functions as a light incident surface of said transmissive photocathode 1A and a second main surface 102*a* that is opposed to the first main surface 101*a*. The photoelectron emission layer 300 has a first main surface 301*a* that is opposed to the second main surface 102*a* of the supporting substrate 100A and a second main surface 302*a* that is opposed to the first main surface 301*a* and functions as a photoelectron emission surface of said transmissive photocathode 1A. The underlayer 200 is arranged between the supporting substrate 100A and the photoelectron emission layer 300 in direct contact with the second main surface 102*a* of the supporting substrate 100A and the first main surface 301*a* of the photoelectron emission layer 300.

In this transmissive photocathode 1A, an incident light hν is made incident from the supporting substrate 100A side, and photoelectrons $e^-$ are emitted from the photoelectron emission layer 300 side in response to the incident light hν. That is, the photoelectron emission layer 300 makes light hν incident from the supporting substrate 100A side, and emits photoelectrons $e^-$ to the side opposite to the supporting substrate 100A. It is preferable that the supporting substrate 100A is made of a material that transmits light with a wavelength of 300 nm to 1000 nm. As such a supporting substrate material, for example, a glass material such as quartz glass or borosilicate glass is appropriate.

On the other hand, FIG. 1(*b*) is a sectional view of a reflective photocathode, which is another embodiment of a photocathode according to the present invention. As shown in FIG. 1(*b*), the reflective photocathode 1B includes a supporting substrate 100B that blocks an incident light hν with a predetermined wavelength, an underlayer 200 provided on the supporting substrate 100B, and a photoelectron emission layer 300 provided on the underlayer 200. The supporting substrate 100B has a first main surface 101*b* and a second main surface 102*b* that is opposed to the first main surface 101*b*. The photoelectron emission layer 300 has a first main surface 301*b* that is opposed to the second main surface 102*b* of the supporting substrate 100B and a second main surface 302*b* that is opposed to the first main surface 301*b* and functions as both a light incident surface and a photoelectron emission surface of said reflective photocathode 1B. The underlayer 200 is arranged between the supporting substrate 100B and the photoelectron emission layer 300 in direct contact with the second main surface 102*b* of the supporting substrate 100B and the first main surface 301*b* of the photoelectron emission layer 300.

In this reflective photocathode 1B, when an incident light hν has reached the supporting substrate 100B from the photoelectron emission layer 300, photoelectrons $e^-$ are emitted from the supporting substrate 100B in a direction toward the photoelectron emission layer 300 in response to the incident light hν. That is, the photoelectron emission layer 300 makes light hν incident from the side opposite to the supporting substrate 100B, and emits photoelectrons $e^-$ to the side opposite to the supporting substrate 100B. It is preferable that the supporting substrate 100B is made of a material that blocks light. As such a supporting substrate material, since the supporting substrate 100B functions as a reinforcing member to support the photoelectron emission layer 300, for example, a metal material such as nickel is appropriate.

In both the transmissive photocathode 1A and transmissive photocathode 1B as described above, the underlayer 200 and the photoelectron emission layer 300 may have the following same structures.

More specifically, the underlayer 200 is made of a crystalline material containing $La_2O_3$. Concretely, the underlayer 200 can be realized by various structures, such as a single-layer structure made of $La_2O_3$, and a multi-layer structure including a layer ($La_2O_3$-based foundation) containing, as a main material, $La_2O_3$ or a $La_2O_3$ single-layer. For example, the underlayer 200 may be made of any one material of a material containing mixed crystals of $La_2O_3$ and BeO ($La_XBe_YO_Z$), a material containing mixed crystals of $La_2O_3$ and MgO ($La_XMg_YO_Z$), and a material containing mixed crystals of $La_2O_3$ and MnO ($La_XMn_YO_Z$). The underlayer 200 having such a structure is formed by any one set of elements of La and Be, La and Mg, and La and Mn being oxidized after being simultaneously or sequentially vapor-deposited onto the substrate. However, it is necessary that the underlayer 200 is made of a crystalline material containing $La_2O_3$ and is in contact with the photoelectron emission layer 300.

Moreover, it is preferable that the photoelectron emission layer 300 is made of a material containing a compound of an alkali metal and Sb. Further, it is preferable that the alkali metal contains at least one of Cs, K, and Na. Such a photoelectron emission layer 300 functions as an active layer of said photocathode 1A, 1B.

As described above, in the photocathode 1A, 1B, the underlayer 200 made of a crystalline material containing $La_2O_3$ is provided between the supporting substrate 100A, 100B and the photoelectron emission layer 300, and is in contact with the photoelectron emission layer 300. Therefore, for example, at the time of heat treatment in a manufacturing process of the photocathode 1A, 1B, dispersion to the supporting substrate 100A, 100B side of an alkali metal contained in the photoelectron emission layer 300 is suppressed. Consequently, a decline in the quantum efficiency of the photoelectron emission layer 300 is effectively suppressed. Further, it is assumed that this underlayer 200 functions so as to reverse the direction of, out of photoelectrons $e^-$ generated within the photoelectron emission layer 300, photoelectrons traveling toward the supporting substrate 100A, 100B side to the side opposite thereto. For this reason, it is considered that the quantum efficiency of the photocathode 1A, 1B as a whole is dramatically improved. Thus, according to the photocathode 1A, 1B, the effective quantum efficiency can be improved.

Next, a photomultiplier tube applied with the photocathode 1A, 1B configured as in the above will be described. Also, in the following description, a supporting substrate simply mentioned without limitation to either of the transmissive photocathode 1A and the reflective photocathode 1B will be denoted with a reference numeral "100."

Figure 2:
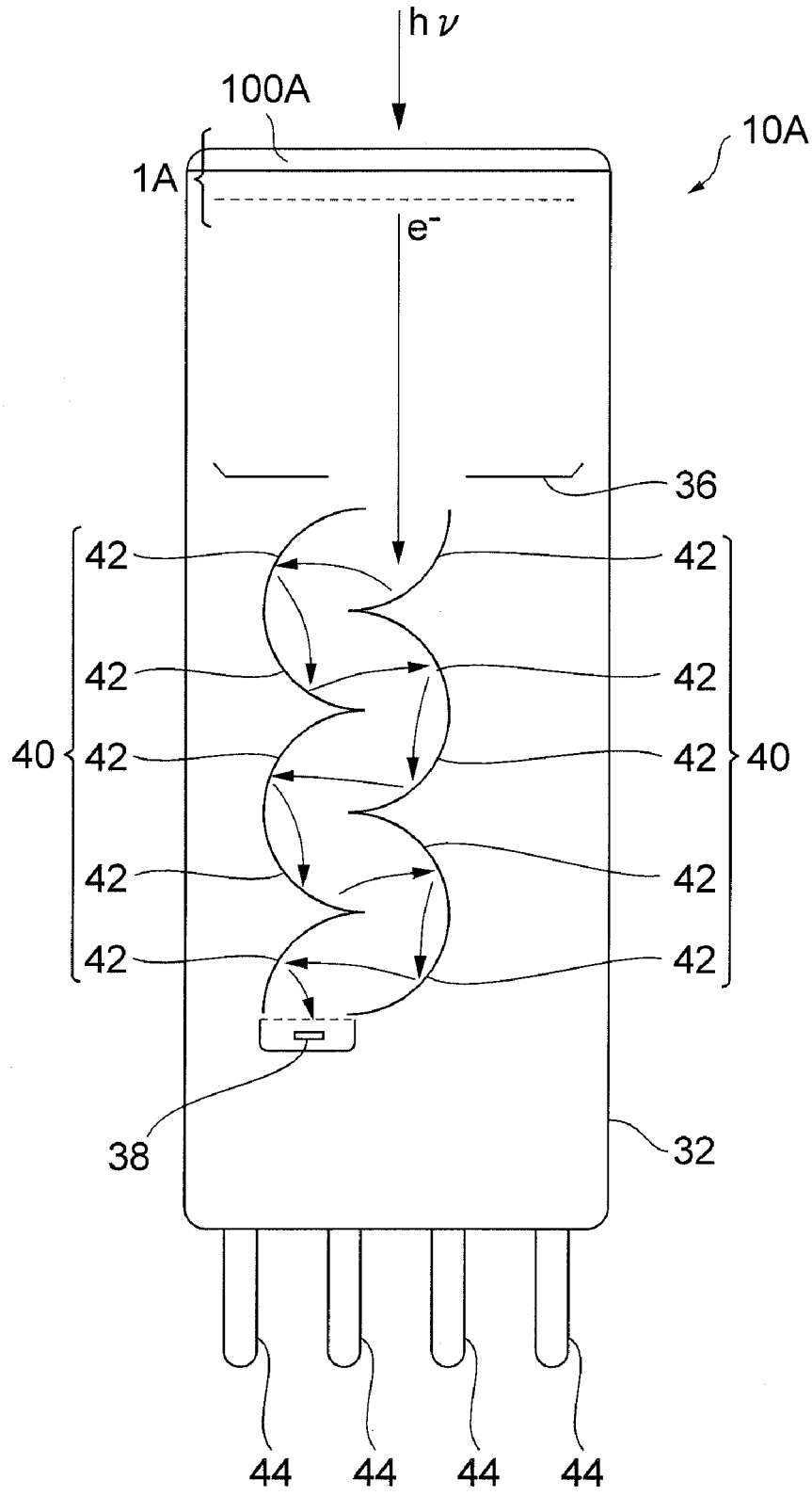
FIG. 2 is a view showing a sectional structure of a photomultiplier tube applied with the transmissive photocathode of FIG. 1(*a*).

FIG. 2 is a view showing a sectional structure of a photomultiplier tube applied with the transmissive photocathode of FIG. 1(*a*). As shown in FIG. 2, the transmissive photomultiplier tube (electron tube) 10A includes a transparent vessel 32 having an incident surface plate that transmits an incident light hν. The incident surface plate of this transparent vessel 32 functions as the supporting substrate 100A of said transmissive photocathode 1A. In the transparent vessel 32, arranged is a photoelectron emission layer 300 via an underlayer 200, and provided are a focusing electrode 36 that guides emitted photoelectrons $e^-$ to a multiplying section 40, the multiplying section 40 that multiplies secondary electrons, and an anode 38 that collects multiplied secondary electrons. In this manner, the transparent vessel 32 stores at least a part of said transmissive photocathode 1A, and the anode 38.

The multiplying section 40 provided between the focusing electrode 36 and the anode 38 is an electron multiplying section for cascade-multiplying photoelectrons $e^-$ emitted from the photocathode 1A, and is composed of a plurality of dynodes (electrodes) 42. Each dynode 42 is electrically connected with a stem pin 44 provided so as to penetrate through the vessel 32.

Figure 3:
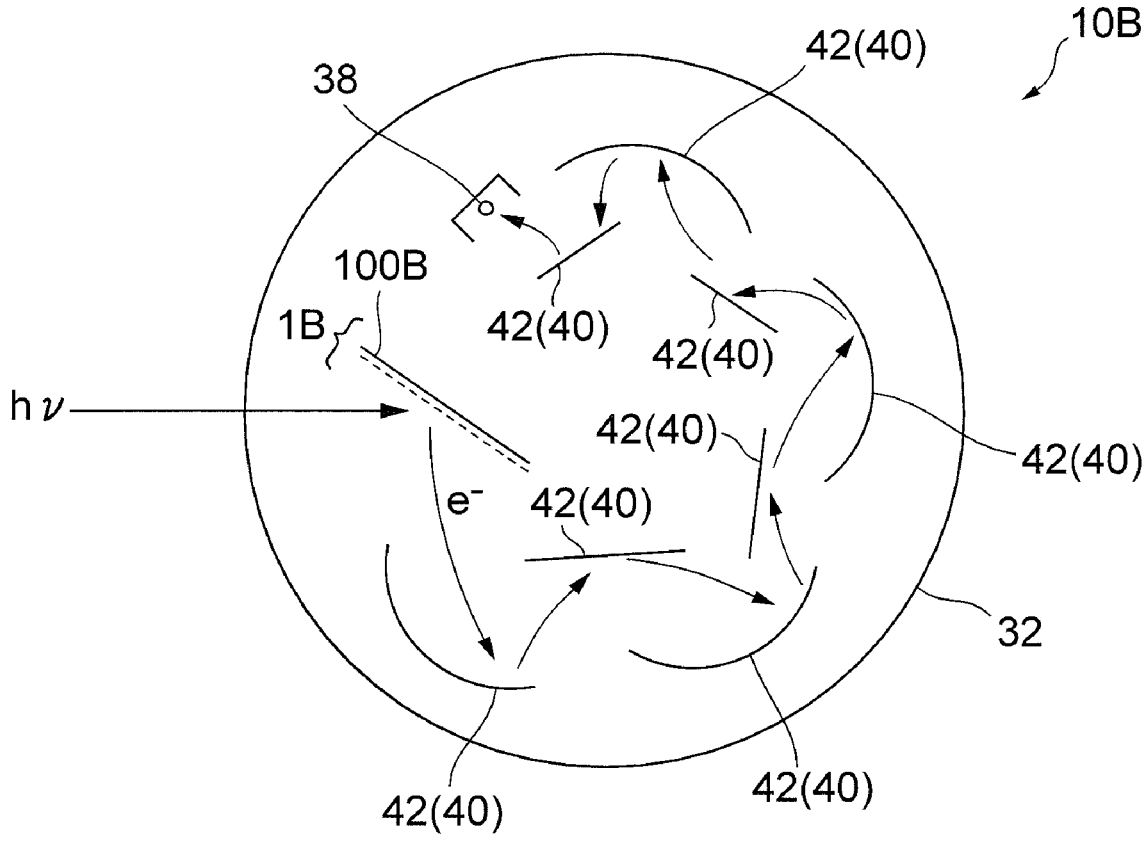
FIG. 3 is a view showing a sectional structure of a photomultiplier tube applied with the reflective photocathode of FIG. 1(*b*).

On the other hand, FIG. 3 is a view showing a sectional structure of a photomultiplier tube applied with the reflective photocathode of FIG. 1(*b*). As shown in FIG. 3, although the reflective photomultiplier tube (electron tube) 10B includes a transparent vessel 32 having an incident surface plate that transmits an incident light hν, the whole of said reflective photocathode 1B including the supporting substrate 100B is arranged in the transparent vessel 32. Further, in the transparent vessel 32, provided is a multiplying section 40 that multiplies photoelectrons $e^-$ emitted from the reflective photocathode 1B and an anode 38 that collects secondary electrons multiplied by the multiplying section 40. In this manner, the transparent vessel 32 stores the whole of said reflective photocathode 1B and the anode 38.

The multiplying section 40 provided between the reflective photocathode 1B and the anode 38 is an electron multiplying section for cascade-multiplying photoelectrons $e^-$ emitted from the photocathode 1B, and is composed of a plurality of dynodes (electrodes) 42. Each dynode 42 is, as in the transmissive photomultiplier tube 10A shown in FIG. 2, electrically connected with a stem pin provided so as to penetrate through the transparent vessel 32.

Next, samples prepared as examples of photocathodes according to the present invention will be described. Although the prepared samples are transmissive photocathodes, with regard to characteristics of reflective photocathodes, description will be omitted since it can be easily inferred that the same characteristics as those of the transmissive photocathodes can be expected.

FIG. 4(*a*) is a table for explaining the types of underlayer structures applied to samples prepared as examples. FIG. 4(*b*) is a table for explaining the types of photoelectron emission layer structures applied to samples prepared as examples. That is, the samples prepared as examples are 24 types that are obtained by combination of six types of underlayers 200 and four types of photoelectron emission layers 300.

As shown in FIG. 4(*a*), structure No. 1 of the underlayer 200 is a $La_2O_3$ single layer having a crystalline structure. Structure No. 2 of the underlayer 200 is a double-layer structure ($La_2O_3$/BeO) of a $La_2O_3$ single layer having a crystalline structure and a BeO single layer (provided that the $La_2O_3$ single layer is in contact with the photoelectron emission layer 300). At an interface between the $La_2O_3$ single layer and the BeO single layer, an alloy ($La_2O_3$—BeO) is formed. Here, in manufacturing of this structure No. 2, $La_2O_3$ and BeO may be simultaneously vapor-deposited, or may be sequentially vapor-deposited.

Structure No. 3 of the underlayer 200 is a double-layer structure ($La_2O_3$/MgO) of a $La_2O_3$ single layer having a crystalline structure and a MgO single layer (provided that the $La_2O_3$ single layer is in contact with the photoelectron emission layer 300), and at an interface between the $La_2O_3$ single layer and the MgO single layer, an alloy ($La_2O_3$—MgO) is formed. Here, in manufacturing of this structure No. 3, $La_2O_3$ and MgO may be simultaneously vapor-deposited, or may be sequentially vapor-deposited. Structure No. 4 of the underlayer 200 is a double-layer structure ($La_2O_3$/MnO) of a $La_2O_3$ single layer having a crystalline structure and a MnO single layer (provided that the $La_2O_3$ single layer is in contact with the photoelectron emission layer 300), and at an interface between the $La_2O_3$ single layer and the MnO single layer, an alloy ($La_2O_3$—MnO) is formed. Here, in manufacturing of this structure No. 4, $La_2O_3$ and MnO may be simultaneously vapor-deposited, or may be sequentially vapor-deposited.

Structure No. 5 of the underlayer 200 is a single layer made of an oxide of a La-alloy having a crystalline structure. Structure No. 6 of the underlayer 200 is a structure where a thin film of $HfO_2$, $Y_2O_3$, and the like is provided on the supporting substrate 100, and provided on this thin film is a $La_2O_3$-based foundation (which can be any one of the abovementioned structures No. 1 to No. 4). This thin film can be made to function as an anti-reflection (AR) coating against an incident light hν. In addition, the film thickness of $HfO_2$, $Y_2O_3$, and the like is selected from a range of 30 Å to 2000 Å.

When an anti-reflection coating made of a material containing at least one of $HfO_2$ and $Y_2O_3$ is thus provided between the supporting substrate 100 and the underlayer 200, light hν can be made incident into the photoelectron emission layer 300 more efficiently. In addition, for making the underlayer 200 made of a crystalline material containing $La_2O_3$ as an anti-reflection coating, it is preferable that the film thickness of the underlayer 200 is selected from a range of 350 Å to 450 Å.

On the other hand, as shown in FIG. 4(*b*), structure No. 1 of the photoelectron emission layer 300 is a K—CsSb ($K_2CsSb$) single layer. Structure No. 2 of the photoelectron emission layer 300 is a Na—KSb ($Na_2KSb$) single layer. Structure No. 3 of the photoelectron emission layer 300 is a Cs—Na—KSb ($Cs(Na_2K)Sb$) single layer. Structure No. 4 of the photoelectron emission layer 300 is a Cs—Te ($Cs_2Te$) single layer.

The aforementioned $MnO_X$, MgO, etc., are known as materials that transmit light with a wavelength of 300 nm to 1000 nm. In addition, the thin-film material $HfO_2$ being a thin-film material exhibits a high transmittance to a light with a wavelength of 300 nm to 1000 nm.

In the above, as a result of a measurement of spectral sensitivity characteristics of each sample of the combinations of structures No. 1 to No. 5 of the underlayer 200 and structures No. 1 to No. 4 of the photoelectron emission layer 300, excellent spectral sensitivity characteristics were obtained.

Figure 5:
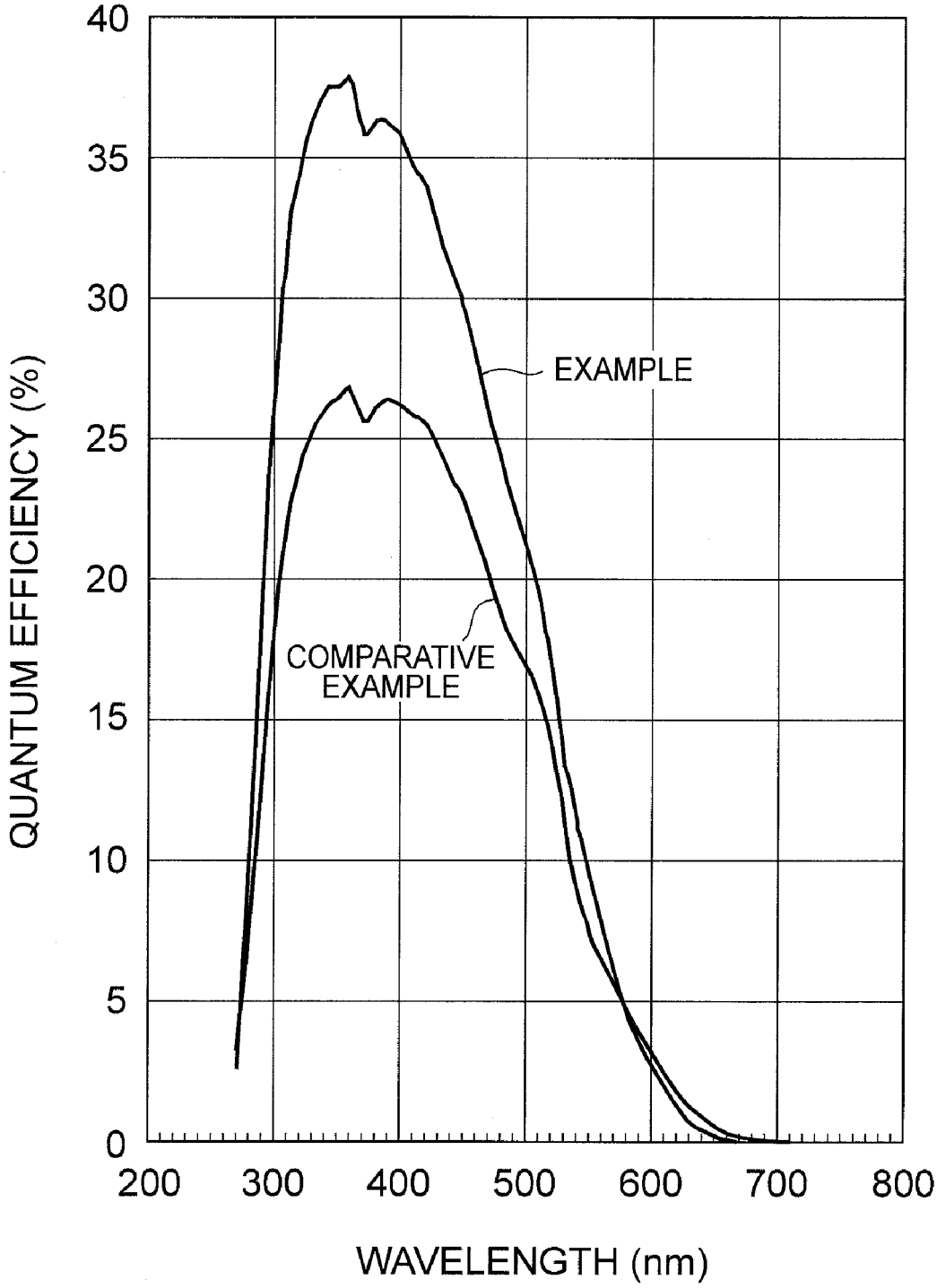
FIG. 5 is a graph showing spectral sensitivity characteristics of a sample prepared as an example of a photocathode according to the present invention and spectral sensitivity characteristics of a sample prepared as a comparative example.

FIG. 5 is a graph showing spectral sensitivity characteristics of a sample prepared as an example of a photocathode according to the present invention and spectral sensitivity characteristics of a sample prepared as a comparative example. In the sample prepared as the example, the underlayer has the above-mentioned structure No. 1, and the photoelectron emission layer has the above-mentioned structure No. 1. On the other hand, in the sample prepared as the comparative example, the photoelectron emission layer has the above-mentioned structure No. 1, while the underlayer is made of $MnO_X$. In addition, both samples were prepared as transmissive photocathodes whose supporting substrates are made of borosilicate glass.

In the sample prepared as the example, the thickness of the underlayer 200 is 200 Å, the thickness of the photoelectron emission layer 300 is 160 Å, and a ratio of the thickness of the photoelectron emission layer 300 to the thickness of the underlayer 200 is 0.8. Moreover, in the sample prepared as the comparative example, the thickness of the underlayer is 30 Å, the thickness of the photoelectron emission layer is 160 Å, and a ratio of the thickness of the photoelectron emission layer to the thickness of the underlayer is 5.3. In addition, the underlayer preferably has a thickness of 5 Å to 800 Å, and the photoelectron emission layer preferably has a thickness of 50 Å to 2000 Å.

As can be understood from FIG. 5, the sample prepared as the example has been improved in quantum efficiency in most of the usable wavelength range in comparison with the sample prepared as the comparative example. Particularly, the quantum efficiency at a wavelength of 360 nm is 26.9% in the sample prepared as the comparative example, whereas in the sample prepared as the example, this is 37.9%, so that an increase in sensitivity of about 40% has been confirmed.

For dramatically improving the effective quantum efficiency as such, in the photocathode 1A, 1B, it is preferable that the ratio of the thickness of the photoelectron emission layer 300 to the thickness of the underlayer 200 is 0.06 to 400. At this time, it is preferable that the thickness of the underlayer 200 is set so as to be within a range of 5 Å to 800 Å, and the thickness of the photoelectron emission layer 300, within a range of 50 Å and 2000 Å.

As described above, the fact that the sample prepared as the example was markedly improved in spectral sensitivity in comparison with the sample prepared as the comparative example is considered to be due to that the underlayer 200 made of a crystalline material containing $La_2O_3$ functions as a barrier layer. More specifically, an alkali metal (for example, K, Cs, and the like) contained in the photoelectron emission layer 300 is considered to move to a layer adjacent to said photoelectron emission layer 300 due to dispersion at the time of heat treatment in a manufacturing process of said photocathode. In this case, it is assumed that a decline in the effective quantum efficiency results therefrom. On the other hand, when the underlayer 200 made of a crystalline material containing $La_2O_3$ is provided as an adjacent layer in contact with the photoelectron emission layer 300, it is considered that diffusion of an alkali metal (for example, K, Cs, and the like) contained in the photoelectron emission layer 300 is effectively suppressed at the time of heat treatment in a manufacturing process. The fact that a high effective quantum efficiency can be realized in a photocathode with the underlayer 200 made of a crystalline material containing $La_2O_3$ is assumed to result therefrom. Further, it is assumed that this underlayer 200 functions so as to reverse the direction of, out of photoelectrons generated within the photoelectron emission layer 300, photoelectrons traveling toward the supporting substrate 100 side to the photoelectron emission layer 300 side. For this reason, it is considered that the quantum efficiency of said photocathode as a whole is dramatically improved.

When a plurality of types of alkaline metals are contained in the photoelectron emission layer 300, it is necessary to supply alkali vapor a plurality of times. Therefore, it is very effective that a decline in the quantum efficiency due to a heat treatment is suppressed.

Next, description will be given of the fact that the photocathode 1A, 1B with the underlayer 200 made of a crystalline material containing $La_2O_3$ (in direct contact with the photoelectron emission layer 300) has superiority over a photocathode with an underlayer made of lanthanum glass (in direct contact with the photoelectron emission layer).

Figure 6:
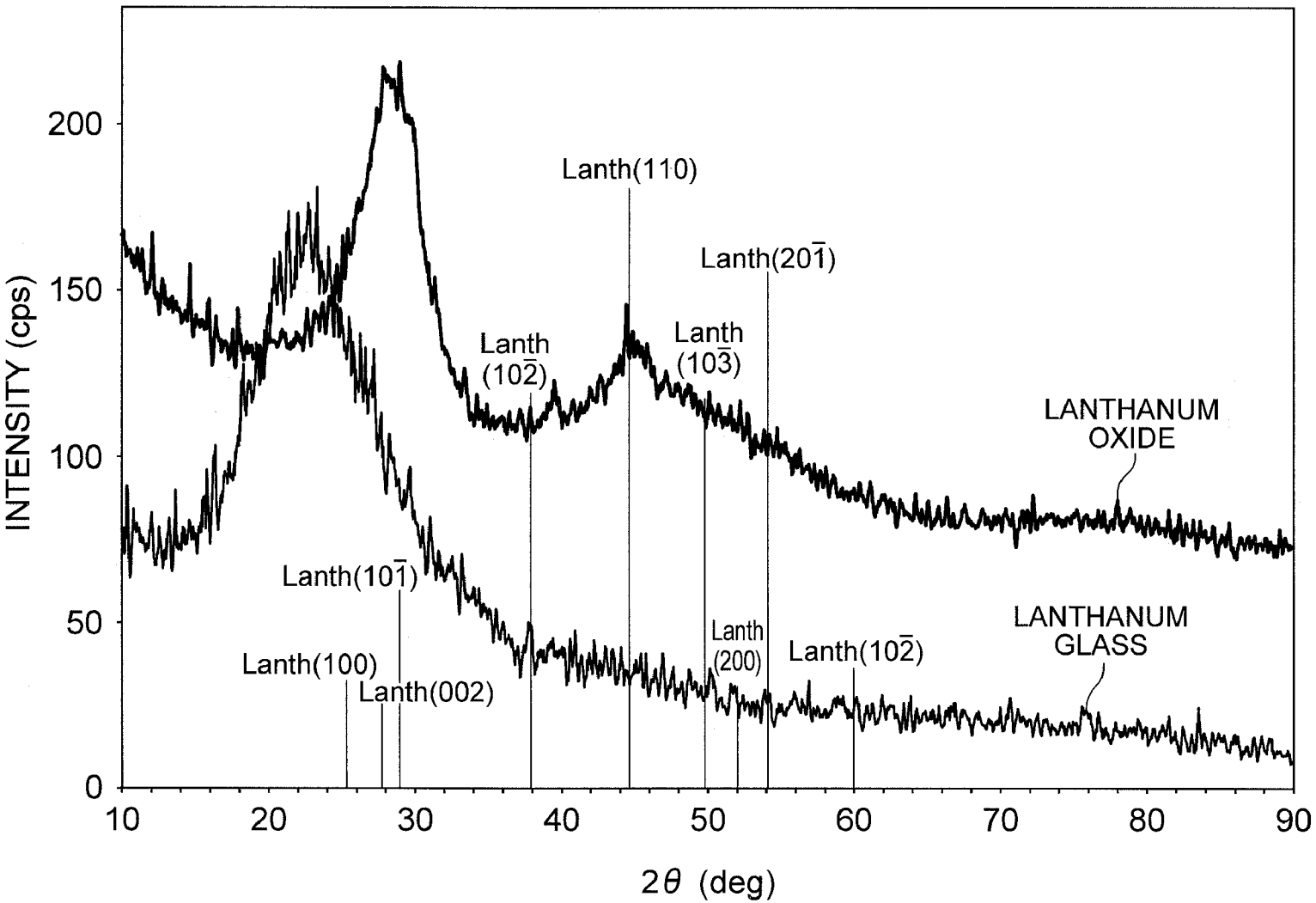
FIG. 6 is a graph showing a result of X-ray diffraction of lanthanum oxide and a result of X-ray diffraction of lanthanum glass.

FIG. 6 is a graph showing a result of X-ray diffraction of lanthanum oxide ($La_2O_3$) and a result of X-ray diffraction of lanthanum glass. As shown in FIG. 6, there is no peak value indicating crystallinity in the lanthanum glass. This indicates that the lanthanum glass is an amorphous material. On the other hand, there is a peak value of Lanth (110) in the $La_2O_3$. This indicates that the lanthanum glass is a material crystallized at its (110) surface. This peak value of Lanth (110) can theoretically exist even when another element is mixed in the $La_2O_3$. Here, an X-ray diffraction system from manufacturer name: Rigaku Corporation, under system name: thin-film X-ray diffractometer (SmartLab) was used under conditions of a tube voltage: 45 kV, a tube current: 200 mA, for In-Plane measurement.

The underlayer made of lanthanum glass is thus different in being amorphous from the underlayer 200 made of a crystalline material containing $La_2O_3$. Therefore, the photocathode 1A, 1B with the underlayer 200 made of a crystalline material containing $La_2O_3$ (in direct contact with the photoelectron emission layer 300) has the following advantages over a photocathode with an underlayer made of lanthanum glass (in direct contact with the photoelectron emission layer).

More specifically, since lanthanum glass has a refractive index of less than 1.8, whereas $La_2O_3$ has a refractive index of 1.95, the underlayer 200 made of $La_2O_3$ is appropriate as an anti-reflection coating. Moreover, since lanthanum glass has a high content rate of impurities such as barium oxide ($Ba_2O_3$) and alkaline-earth metal oxides, whereas it is possible in $La_2O_3$ to suppress the content of impurities to a low rate, adverse effect on the photoelectron emission surface (layer) being in direct contact therewith can be prevented. Moreover, since lanthanum glass induces a movement of an alkali metal from the photoelectron emission surface (layer) being in direct contact therewith, whereas $La_2O_3$ suppresses a movement of an alkali metal from the photoelectron emission surface (layer) being in direct contact therewith, a decline in sensitivity can be prevented. Further, since it is difficult to form a thin film of lanthanum glass at a thickness of a few millimeters or less, whereas it is possible to form a thin film of $La_2O_3$ on the order of a few angstroms, absorption of light in the ultraviolet region etc., can be suppressed.

FIG. 7 is a table for explaining the types of underlayer structures applied to samples prepared as other examples. That is, the samples prepared as other examples are 16 types that are obtained by combination of the four types of underlayers 200 shown in FIG. 7 and the four types of photoelectron emission layers 300 shown in FIG. 4(*b*).

As shown in FIG. 7, structure No. 11 of the underlayer 200 is a double-layer structure of a $La_2O_3$ single layer having a crystalline structure and a lanthanum glass single layer (provided that the $La_2O_3$ single layer is in contact with the photoelectron emission layer 300). More specifically, structure No. 11 of the underlayer 200 is a structure where a lanthanum glass single layer is provided on the supporting substrate 100, and formed on this lanthanum glass is a $La_2O_3$ single layer. Here, in manufacturing of this structure No. 11, lanthanum glass is fixed to the inner surface of the transparent vessel 32, while $La_2O_3$ is vapor-deposited on this lanthanum glass by sputtering.

Structure No. 12 of the underlayer 200 is a layer containing mixed crystals of $La_2O_3$ and BeO. In this structure No. 12, $La_2O_3$ along with BeO is in contact with the photoelectron emission layer 300. Here, in manufacturing of structure No. 12, La and Be are simultaneously or sequentially vapor-deposited on the supporting substrate 100, and then oxidized. Structure No. 13 of the underlayer 200 is a layer containing mixed crystals of $La_2O_3$ and $Y_2O_3$. In this structure No. 13, $La_2O_3$ along with $Y_2O_3$ is in contact with the photoelectron emission layer 300. Here, in manufacturing of structure No. 13, La and Y are simultaneously or sequentially vapor-deposited on the supporting substrate 100, and then oxidized. Structure No. 14 of the underlayer 200 is a layer containing mixed crystals of $La_2O_3$ and $HfO_2$. In this structure No. 14, $La_2O_3$ along with $HfO_2$ is in contact with the photoelectron emission layer 300. Here, in manufacturing of structure No. 14, La and Hf are simultaneously or sequentially vapor-deposited on the supporting substrate 100, and then oxidized.

In the above, as a result of a measurement of spectral sensitivity characteristics of each sample of the combinations of structures No. 11 to No. 14 of the underlayer 200 and structures No. 1 to No. 4 of the photoelectron emission layer 300, excellent spectral sensitivity characteristics were obtained.

Figure 8:
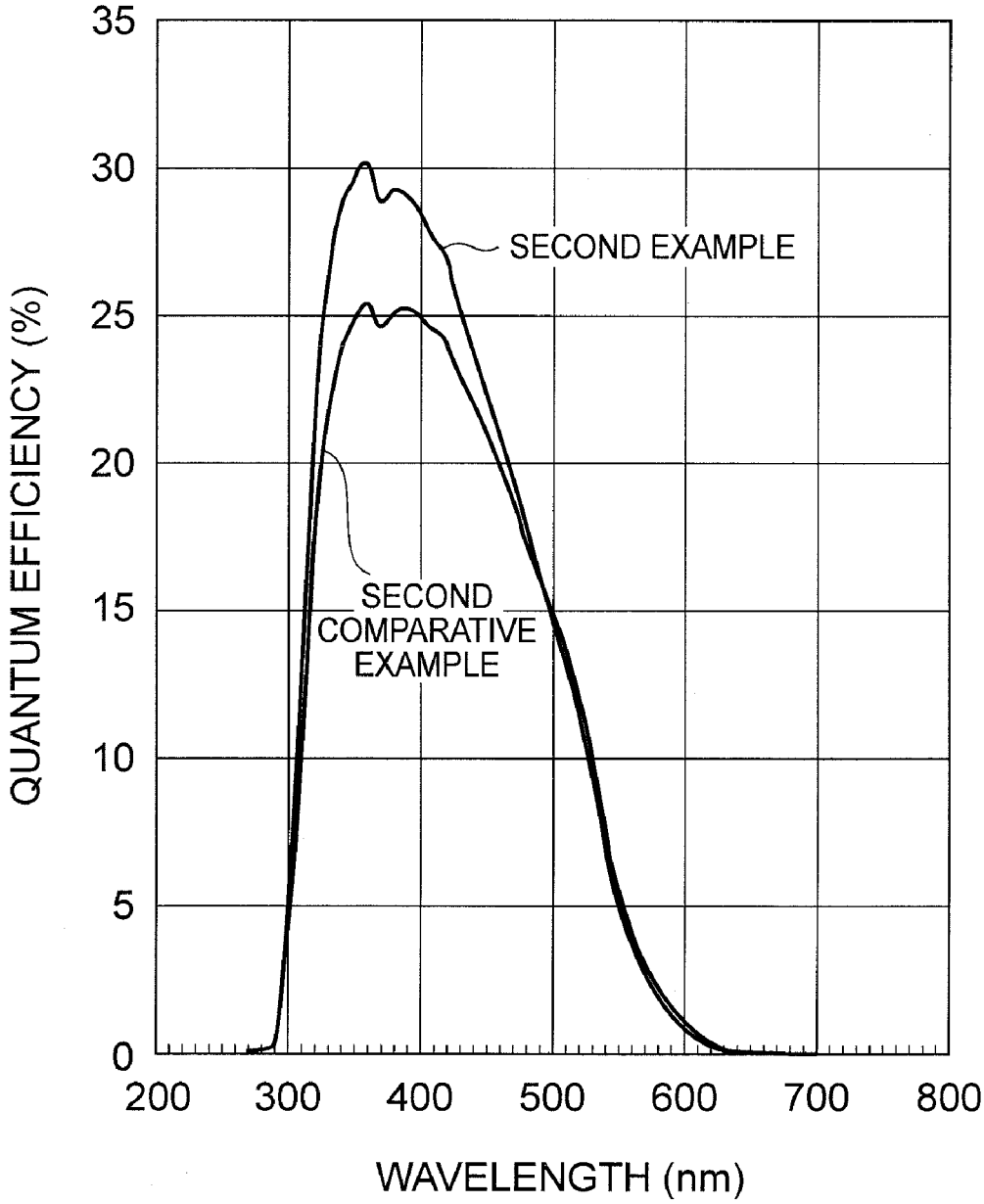
FIG. 8 is a graph showing spectral sensitivity characteristics of a sample prepared as another example of a photocathode according to the present invention and spectral sensitivity characteristics of a sample prepared as another comparative example.

FIG. 8 is a graph showing spectral sensitivity characteristics of a sample prepared as another example of a photocathode according to the present invention and spectral sensitivity characteristics of a sample prepared as another comparative example (hereinafter, referred to as a second comparative example). Here, as other examples, four types of samples corresponding to a second example to a fifth example were prepared.

In the sample prepared as the second example, the underlayer has the above-mentioned structure No. 11. In the sample prepared as the third example, the underlayer has the above-mentioned structure No. 12. In the sample prepared as the fourth example, the underlayer has the above-mentioned structure No. 13. In the sample prepared as the fifth example, the underlayer has the above-mentioned structure No. 14. Moreover, in the respective samples prepared as the second example to the fifth example, the photoelectron emission layer has the above-mentioned structure No. 1. On the other hand, in the sample prepared as the second comparative example, the photoelectron emission layer has the above-mentioned structure No. 1, while the underlayer is made of a lanthanum glass single layer. In addition, the respective samples of the second example to the fifth example and the second comparative example were prepared as transmissive photocathodes whose supporting substrates are made of borosilicate glass.

In the sample prepared as the second example, the thickness of the underlayer 200 is 1 mm+300 Å (lanthanum glass 1 mm+$La_2O_3$ having a crystalline structure 300 Å), the thickness of the photoelectron emission layer 300 is 200 Å. In the respective samples prepared as the third example to the fifth example, the thickness of the underlayer 200 is 250 Å, the thickness of the photoelectron emission layer 300 is 200 Å. Moreover, in the sample prepared as the second comparative example, the thickness of the underlayer is 1 mm, the thickness of the photoelectron emission layer is 200 Å.

As can be understood from FIG. 8, the sample prepared as the second example has been improved in quantum efficiency in most of the usable wavelength range in comparison with the sample prepared as the second comparative example. Particularly, the quantum efficiency at a wavelength of 360 nm is 25.4% in the sample prepared as the second comparative example, whereas in the sample prepared as the second example, this is 30.1%, so that an increase in sensitivity of about 20% has been confirmed. Thus, it has been confirmed that the photocathode 1A, 1B with the underlayer 200 made of two layers of a $La_2O_3$ single layer having a crystalline structure and a lanthanum glass single layer (the $La_2O_3$ single layer is in contact with the photoelectron emission layer 300) has superiority over a photocathode with an underlayer made of a lanthanum glass single layer (the lanthanum glass single layer is in contact with photoelectron emission layer).

Figure 9:
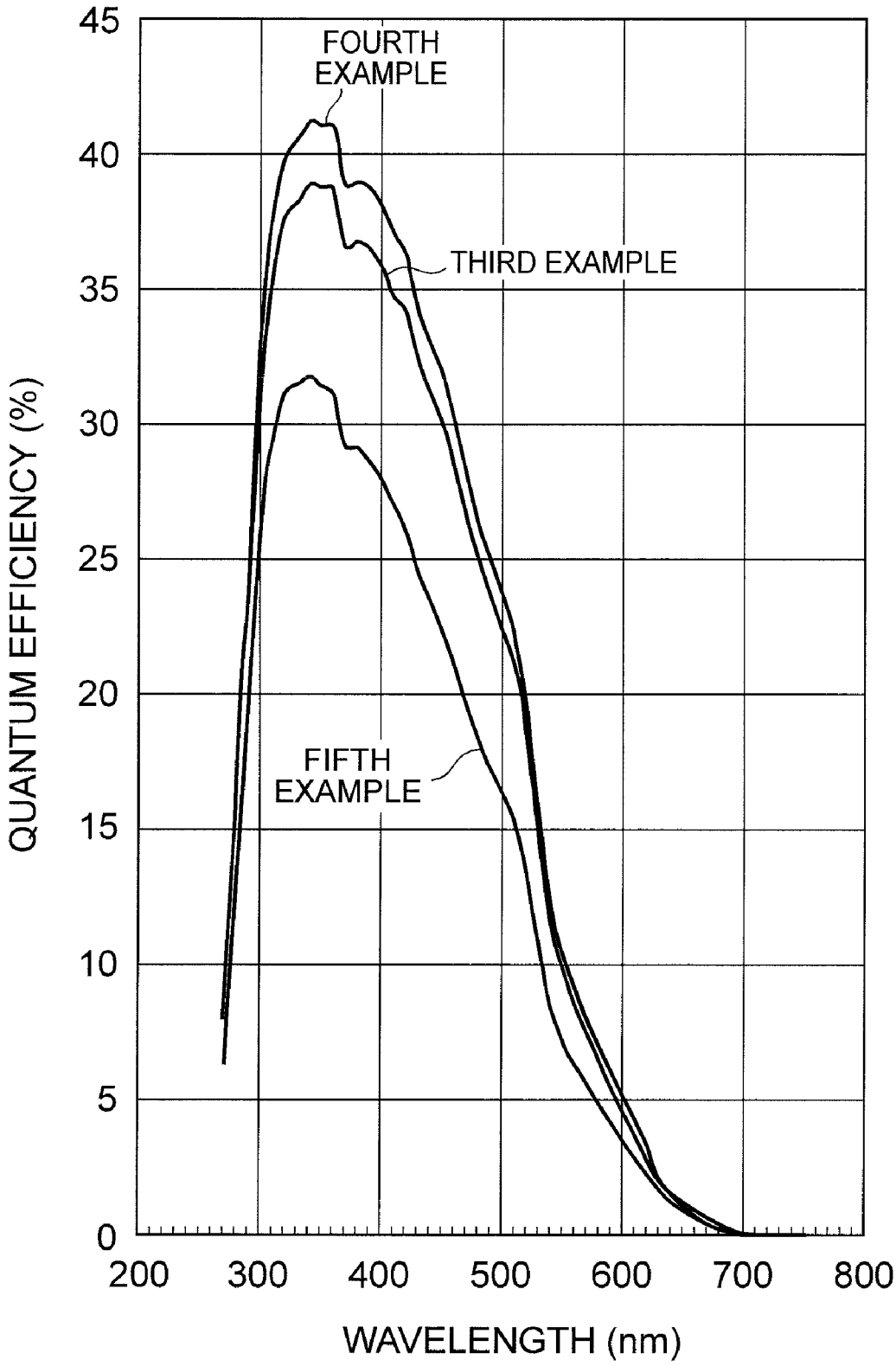
FIG. 9 is a graph showing spectral sensitivity characteristics of samples prepared as other examples of photocathodes according to the present invention.

Moreover, as can be understood from FIG. 9, also in the samples prepared as the third example to the fifth example, excellent spectral sensitivity characteristics were obtained. Particularly, the quantum efficiency at a wavelength of 360 nm is 38.7% in the sample prepared as the third comparative example, and in the sample prepared as the fourth comparative example, this is 41.0%, and in the sample prepared as the fifth comparative example, this is 31.1%. Thus, it has been confirmed that the photocathode 1A, 1B with the underlayer 200 made of a layer containing mixed crystals of $La_2O_3$ and BeO, mixed crystals of $La_2O_3$ and $Y_2O_3$, or mixed crystals of $La_2O_3$ and $HfO_2$ (in any case, $La_2O_3$ is in contact with the photoelectron emission layer 300) has superiority over a photocathode with an underlayer made of a lanthanum glass single layer (the lanthanum glass single layer is in contact with photoelectron emission layer).

According to one embodiment of the present invention, the effective quantum efficiency can be improved.

What is claimed is:

1. A photocathode which emits photoelectrons in response to incidence of light, comprising:

a supporting substrate;

an underlayer provided on the supporting substrate; and a photoelectron emission layer provided on the underlayer, and made of a material containing an alkali metal, wherein the underlayer is made of a crystalline material containing lanthanum oxide, and in contact with the photoelectron emission layer.

2. The photocathode according to claim 1, wherein a ratio of a thickness of the photoelectron emission layer to a thickness of the underlayer is 0.06 to 400.

3. The photocathode according to claim 1, wherein the photoelectron emission layer is made of a material containing a compound of the alkali metal and antimony.

4. The photocathode according to claim 1, wherein the photoelectron emission layer is made of a material containing at least one of cesium, potassium, and sodium as the alkali metal.

5. The photocathode according to claim 1, wherein the underlayer is made of a material containing mixed crystals of the lanthanum oxide and beryllium oxide.

6. The photocathode according to claim 1, wherein the underlayer is made of a material containing mixed crystals of the lanthanum oxide and magnesium oxide.

7. The photocathode according to claim 1, wherein the underlayer is made of a material containing mixed crystals of the lanthanum oxide and manganese oxide.

8. The photocathode according to claim 1, wherein the underlayer is made of a material containing mixed crystals of the lanthanum oxide and a rare earth element.

9. The photocathode according to claim 1, wherein the underlayer is made of a material containing mixed crystals of the lanthanum oxide and an alkaline earth element.

10. The photocathode according to claim 1, wherein the underlayer is made of a material containing mixed crystals of the lanthanum oxide and a titanium family element.

11. The photocathode according to claim 1, wherein between the supporting substrate and the underlayer, an antireflection coating made of a material containing at least one of hafnium oxide and yttrium oxide is provided.

12. The photocathode according to claim 1, wherein the supporting substrate is made of a material that transmits the light, and the photoelectron emission layer makes the light incident from the supporting substrate side, and emits the photoelectrons to a side opposite to the supporting substrate.

13. The photocathode according to claim 1, wherein the supporting substrate is made of a material that blocks the light, and the photoelectron emission layer makes the light incident from a side opposite to the supporting substrate, and emits the photoelectrons to the side opposite to the supporting substrate.

14. An electron tube comprising:

the photocathode according to claim 1;

an anode that collects photoelectrons emitted from the photocathode; and a vessel that stores the photocathode and the anode.

15. A photomultiplier tube comprising:

the photocathode according to claim 1;

an electron multiplying section for cascade-multiplying photoelectrons emitted from the photocathode;

an anode that collects secondary electrons emitted from the electron multiplying section; and a vessel that stores the photocathode, the electron multiplying section, and the anode.

* * * * *